US006057254A

United States Patent [19]

Bender et al.

[11] Patent Number: 6,057,254

[45] Date of Patent: May 2, 2000

[54] PROCESS FOR MANUFACTURE OF AN ACOUSTIC PANEL AND ACOUSTIC PANEL WITH SANDWICH CONSTRUCTION

[75] Inventors: Klaus Bender, Biebertal; Robert Wachter, Wetzlar; Bernd Fiedler, Lahnau, all of Germany

[73] Assignee: Wilhelmi Werke AG, Lahnau, Germany

[21] Appl. No.: 09/101,625

[22] PCT Filed: Nov. 22, 1996

[86] PCT No.: PCT/EP96/05150

§ 371 Date: Jul. 9, 1998

§ 102(e) Date: Jul. 9, 1998

[87] PCT Pub. No.: WO97/25491

PCT Pub. Date: Jul. 17, 1997

[30] Foreign Application Priority Data

Jan. 10, 1996 [DE] Germany ..... 196 00 586

[51] Int. Cl.[7] ..... D04H 5/18; B32B 5/00

[52] U.S. Cl. ..... 442/374; 442/370; 442/381; 442/386; 442/395; 428/198; 156/176; 156/196; 156/295; 156/313; 264/257

[58] Field of Search ..... 442/370, 374, 442/381, 386, 395; 428/198; 156/176, 196, 295, 313; 264/257

[56] References Cited

U.S. PATENT DOCUMENTS

| | | | |
|---|---|---|---|
| 4,091,160 | 5/1978 | Koss | 442/120 |
| 4,539,244 | 9/1985 | Beggs et al. | 428/116 |
| 4,607,466 | 8/1986 | Allred | 52/144 |
| 4,641,726 | 2/1987 | Fearon et al. | 181/292 |
| 5,298,694 | 3/1994 | Thompson et al. | 181/286 |
| 5,554,830 | 9/1996 | Muller et al. | 181/290 |
| 5,661,273 | 8/1997 | Bergiadis | 181/290 |
| 5,910,082 | 6/1999 | Bender et al. | 52/144 |

FOREIGN PATENT DOCUMENTS 14 84 072 12/1968 Germany .

*Primary Examiner*—Blaine Copenheaver
*Assistant Examiner*—Ula C. Ruddock
*Attorney, Agent, or Firm*—Flynn, Thiel, Boutell & Tanis, P.C.

[57] ABSTRACT

A dimensionally stable and fireproof acoustic panel includes an underlying panel covered on one or both sides by a cover panel. The underlying panel can be produced with a cover layer on the interior side thereof. The cover layer is composed of two layers, a coarse-pored stabilizing intermediate layer which in turn is covered by a second, fine-pored outer layer, both of which are bonded to one another and to the underlying panel by a matrix of adhesive material.

19 Claims, 2 Drawing Sheets

PROCESS FOR MANUFACTURE OF AN ACOUSTIC PANEL AND ACOUSTIC PANEL WITH SANDWICH CONSTRUCTION

FIELD OF THE INVENTION

The invention relates to a process for the manufacture of an acoustic panel in sandwich construction as a structural element for sound-absorbing ceilings or walls in a porous underlying panel and a room comprising a porous cover layer provided at least on the panel surface of the underlying panel facing the to room, which cover layer is is glued to the underlying panel such that the porosity of the cover layer is not being bothered. The invention relates furthermore to an acoustic panel in sandwich construction as a structural element for sound-absorbing ceilings or walls in a room comprising a porous underlying panel and a porous cover layer provided on the panel surface of the underlying panel facing the room.

BACKGROUND OF THE INVENTION

The above described acoustic panel is already known from the DE-U-9300151, in which an underlying panel consisting of a porous, elastic synthetic resin is improved regarding its degree of sound absorption when it is covered (on one side or both sides) with thin cover layers of a fleece or fabric of glass, plastic or natural fibers, whereby in a conventional manner also the dimensional stability of the entire acoustic ceiling can be improved. To connect the cover layer(s) to the underlying panel an adhesive is used, which is thereby supposed to be applied in such a manner that the porosity of the underlying panel and of the cover layers is not bothered and the air in the room can circulate through the acoustic panel.

It is also already known from the Offenlegungsschrift DE 31 47 174 A1 to use for the cover layer a layer connection of the actual cover layer and of a sandwich-type plasterboard so that the controversial conditions can be met. The cover layer is thereby fastened on the underlying fabric by means of a binding agent; the same binding agent is used for gluing the underlying fabric to the sandwich-type plasterboard, which is used in a perforated design in order to achieve the desired sound permeability to the actual soundabsorbing underlying panel.

The use of an underlying fabric for the cover layer is unfavorable because its structure can show on the room-side visible surface of the cover layer mainly when the connection of the acoustic panel is compressed by means of a pressure plate, which is necessary already because of the adhesive layer. When the underlying panel consists of a granulation mixed with a binding agent, then moreover such a compression assures at the same time the binding of the individual granules. The use of such a granulation is already described in the Patent DE 14 84 072 C3 where the binding agent envelopes both the individual granules and also causes the holding together of the granules.

The use of swelled perlites or vermiculites as granulation for the underlying panel has been known already for a long time in particular for nonburning acoustic panels, just like the connection of the granulation by means of an inorganic binding agent. These acoustic panels also show the same disadvantages as they have been discussed in detail already above.

The purpose of the invention is therefore to disclose a process for the manufacture of an acoustic panel of the above in detail identifies type and an acoustic panel where the discussed deficiencies of the state of the art are avoided and a statically relatively highly stressable acoustic panel is constructed both with a good sound absorption and also an inability to burn. The manufacture of such an acoustic panel is thereby supposed to be possible without any problems and inexpensively. The adhesive is not supposed to significantly influence the porosity of the acoustic panel.

SUMMARY OF THE INVENTION

According to the invention the purpose is attained first through a process with the characteristics of claim, the intermediate and the outer layer are connected with one another and to the underlying panel by means of an adhesive applied like an adhesive matrix, whereby first the outer layer and the intermediate layer are placed one on top of the other on a base used as an abutment, whereby furthermore the adhesive matrix is applied in such a manner to the upwardly pointing layer surface of the intermediate layer that the matrix points from the adhesive penetrate through the intermediate layer and contact the outer layer, whereby thereafter the granulation of the underlying panel is applied as fill to the so prepared cover layer, and that finally the acoustic panel is compressed by means of a pressure plate stressing the underlying panel.

It is assured in this manner that the adhesive is very evenly distributed, however, it is not applied to cover the entire surface and right from the start the ratio between the surface covered by the adhesive and the surface remaining without adhesive is guaranteed. The surface pressure on the cover layer during its bearing on the underlying panel is chosen in dependency of the thickness and consistency of the applied adhesive in such a manner that under the action of the pressure plate a sufficiently solid connection to the underlying panel occurs without the degree of coverage of the adhesive being significantly increased. The function of the acoustic panel is maintained in this manner, and the fibers of the fleece or of the fabric of the cover layer(s) are thereby at the same time evenly glued together. Depending on the type of adhesive being used, the adhesive matrix can be designed more or less wide-meshed and can be adapted with little effort to the respective conditions.

The granulation is advantageously formed by granules, which are covered by a binding agent, which, during the compression of the pressure plate, binds the individual granules to one another so that a stable underlying panel with a high porosity is created.

The stability of the acoustic panel is increased when the panel surface of the underlying panel not facing the room has a further cover layer, which is applied to the fill of the underlying panel prior to the compression of the acoustic panel. This cover layer can consist undivided out of a glass-fiber fleece or the like.

A satisfactory, highly stressable connection of the various layers of the acoustic panel is obtained when the glued acoustic panel is hardened after the compression through the pressure plate, preferably at a temperature of between 140 and 250° C.

The purpose with respect to the acoustic panel is attained by the characteristics of claim 5.

The acoustic panel can have a further, preferably undivided cover layer, for example of a relatively coarse-pored and stable fleece or fabric, on its panel surface of the underlying panel not facing the room.

The underlying panel consists advantageously of a granular material, which is formed of granules, which are connected by means of a binding agent.

The granules, preferably consisting of a mineral material like swelling glass, swelling clay, basalt balls, perlites or the like or of a mixture formed of these, can have a granule size of between 0.25 and 8 mm, and can, just like the binding agent, consist of an inorganic material. Water glass has proven to be successful as the binding agent, preferably enriched with one or several additives like phosphates or the like.

An inorganic fleece or fabric, preferably of glass fibers, is suited for the intermediate layer and/or the outer layer, whereby the intermediate layer is best formed of a glass fiber mat, whereas the outer layer is formed of a glass fiber fleece.

The adhesive can construct a pointlike adhesive matrix, whereby the matrix points are formed by adhesive particles, each single one of which connects the underlying panel, the intermediate layer and the outer layer with one another. However, it is also possible that the adhesive is constructed in each case between the underlying panel and the cover layers and/or between the intermediate layer and the outer layer as a latticed adhesive matrix, for example, in the form of an adhesive fleece. It consists preferably of a mixture of water glass and additives, in particular, phosphates.

An inventive acoustic panel can be used as a highly sound and also heat insulating panel and has thereby, in spite of the extremely light weight, a high stability without that the cover layer(s) is fastened on the underlying panel by means of a flat-applied adhesive film. The acoustic panel meets, when manufactured according to the invention, also all demands with respect to fire safety and can be manufactured inexpensively.

BRIEF DESCRIPTION OF THE DRAWINGS

The invention will be discussed in greater detail hereinafter in connection with one exemplary embodiment and the drawings, in which.

DETAILED DESCRIPTION

Figure 1:
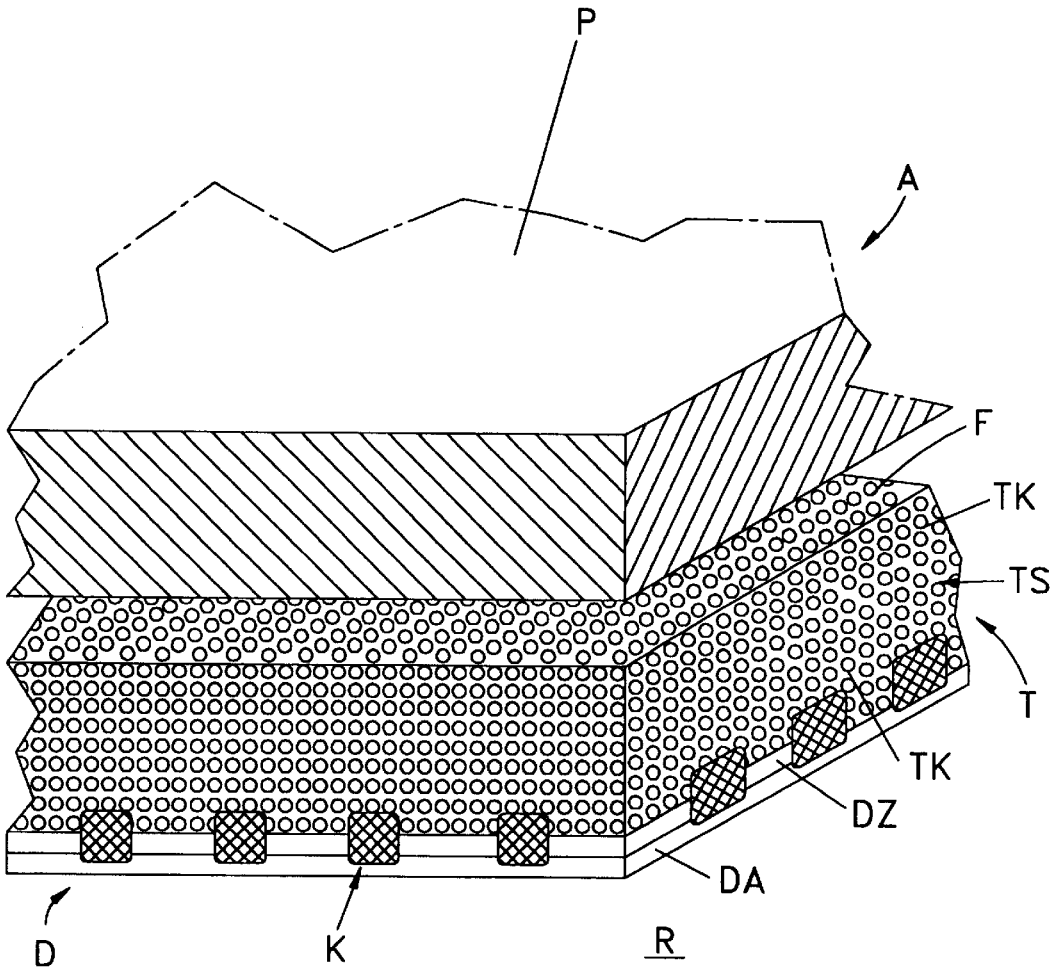
FIG. 1 shows an inventive acoustic panel in a first phase of its manufacture.

FIG. 1 of the drawings shows an inventive acoustic panel A, which consists of an underlying panel T and a cover layer D. The cover layer D is fixed to a panel surface F facing a room R. The cover layer D rests on a stationary, flat base (not shown in the drawings), which furthermore serves as an abutment during the compression of the acoustic panel A.

The underlying panel T is manufactured out of a fill TS of individual granules TK through pressing by means of a pressure plate P. FIG. 1 symbolically indicates the loose fill TS of the granules TK and FIG. 2 symbolically indicates the granulation TK' of the underlying panel T sintered therefrom. The granules TK are right from the start covered with a binding agent, which after the pressing of the fill TS causes the granulation TK' to hold together.

The underlying panel T is connected by its panel surface or outer surface F facing the room R to the cover layer D through an adhesive K.

The cover layer D consists of an intermediate layer DZ contacting the panel surface F and an outer layer DA facing the room R, both of which overlap panel surface F. The intermediate layer DZ is constructed out of a relatively coarse—pored and stable fleece, whereas the outer layer DA is constructed of a fine-pored, flexible fleece.

The outer layer DA and the intermediate layer DZ are in FIG. 1 placed one on top of the other and are covered matrixlike with an adhesive K, which is concentrated in the matrix points; its amount and consistency and the porosity of the intermediate layer DZ are dimensioned such that the adhesive particles K' in the matrix points penetrate alone due to their gravity and due to the stress from the fill TS through the intermediate layer DZ and contact the outer layer DA or flow limited into its surface.

Figure 2:
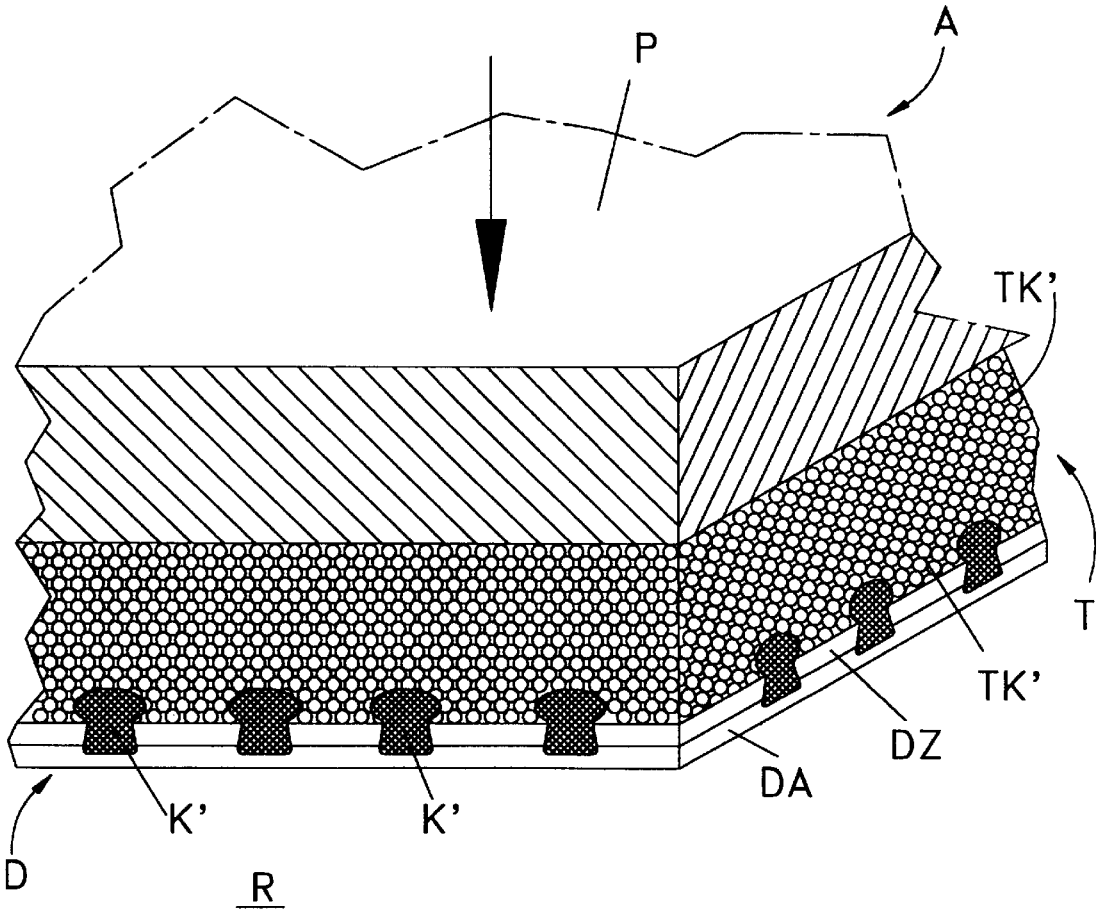
FIG. 2 shows the finished acoustic panel, both in a schematic, three-dimensional illustration.

The pressure plate P is in accordance with FIG. 2 subsequently lowered and the acoustic panel A is pressed; the hardening of the adhesive K takes place thereafter, after which the now final acoustic panel A is again relieved.

We claim:

1. An acoustic panel with a sandwich construction as a structural element for sound-absorbing ceilings or walls in a room, comprising a porous underlying panel and a porous cover layer provided at least on an outer surface of the underlying panel facing the room, wherein the cover layer comprises an intermediate layer disposed over the outer surface of the underlying panel and a visible outer layer facing the room, wherein the intermediate layer comprises a relatively coarse-pored and stable fleece or fabric, the outer layer comprises a relatively fine-pored and flexible fleece or fabric, and the intermediate layer and the outer layer are connected with one another and with the underlying panel by means of an adhesive, which forms either a point-like or grid-shaped adhesive matrix and adhesive particles connect the underlying panel, the intermediate layer and the outer layer with one another.

2. The acoustic panel according to claim 1, wherein a second outer surface of the underlying panel not facing the room is covered with a second cover layer of a relatively coarse-pored and stable fleece or fabric.

3. The acoustic panel according to claim 1, wherein the underlying panel comprises a granular material, which is formed of granules connected to each other by means of a binding agent.

4. The acoustic panel according to claim 3, wherein the granules have a granule size of between 0.25 and 8 mm.

5. The acoustic panel according to claim 3, wherein the granules or the binding agent comprise an inorganic material.

6. The acoustic panel according to claim 5, wherein the granules are one or more members selected from the group consisting of swelling glass, swelling clay, basalt balls or perlites.

7. The acoustic panel according to claim 5, wherein the binding agent comprises a water glass.

8. The acoustic panel according to claim 7, wherein the water glass of the binding agent is enriched with phosphates.

9. The acoustic panel according to claim 1, wherein the intermediate layer and/or the outer layer comprises an inorganic fleece or fabric.

10. The acoustic panel according to claim 9, wherein the intermediate layer is formed by a glass fiber mat.

11. The acoustic panel according to claim 9, wherein the outer layer comprises a glass fiber and/or polyester fleece.

12. The acoustic panel according to claim 9, wherein the inorganic fleece or fabric comprises glass fibers.

13. The acoustic panel according to claim 1, wherein the adhesive forms a pointlike adhesive matrix having matrix points formed by the adhesive particles.

14. The acoustic panel according to claim 1, wherein the adhesive comprises a mixture of water glass and additives.

15. The acoustic panel of claim 14, wherein the additives from which the adhesive is formed include phosphates.

16. A process for the manufacture of an acoustic panel having a sandwich construction as a structural element for sound-absorbing ceilings or walls in a room comprising a porous underlying panel formed from granular material and a porous cover layer provided at least on an outer surface of the underlying panel facing the room, wherein the cover layer is adhered to the underlying panel in such a manner that the porosity of the cover layer is not affected, wherein the cover layer comprises an intermediate layer resting directly on the outer surface of the underlying panel and a visible outer layer facing the room, wherein the intermediate layer comprises a relatively coarse-pored and stable fleece or fabric and the outer layer comprises a relatively fine-pored and flexible fleece or fabric, wherein the intermediate layer and the outer layer are connected with one another and with the underlying panel by means of an adhesive applied as an adhesive matrix, comprising the steps of:

(a) placing first the outer layer and then the intermediate layer one on top of the other onto a base used as an abutment, (b) applying the adhesive matrix to an upwardly directed surface of the intermediate layer in such a manner that matrix points of the adhesive penetrate through the intermediate layer and contact the outer layer, (c) applying the granular material that forms the underlying panel as fill onto the cover layer, and (d) subsequently compressing the acoustic panel by means of a pressure plate which compresses the underlying panel.

17. The process according to claim 16, including forming the underlying panel by covering the granular material with a binding agent so that, during the compression by the pressure plate, granules of the granular material bind to one another.

18. The process according to claim 16, wherein a second outer surface of the underlying panel not facing the room includes a second cover layer, and the process includes placing the second cover layer onto the fill of the underlying panel prior to the compression of the acoustic panel.

19. The process according to claim 16, including hardening the adhesive of the acoustic panel at a temperature of between 140° and 250° C. after compression of the acoustic panel by the pressure plate.

* * * * *